US006676512B2

(12) United States Patent
Fong et al.

(10) Patent No.: US 6,676,512 B2
(45) Date of Patent: Jan. 13, 2004

(54) GAMING MACHINE WITH MYSTERY NUDGE SYMBOL

(75) Inventors: Colin Fong, Lane Cove (AU); Natalie Bryant, Lane Cove (AU)

(73) Assignee: Aristocrat Technologies Australia PTY LTD, Lane Cove (AU)

( * ) Notice: Subject to any disclaimer, the term of this patent is extended or adjusted under 35 U.S.C. 154(b) by 192 days.

(21) Appl. No.: 10/072,446

(22) Filed: Feb. 6, 2002

(65) Prior Publication Data

US 2002/0119814 A1 Aug. 29, 2002

(30) Foreign Application Priority Data

Feb. 9, 2001 (AU) ..... PR 3011

(51) Int. Cl.[7] ..... G07F 17/34; A63F 9/24

(52) U.S. Cl. ..... 463/20; 463/31; 463/16; 273/143 R

(58) Field of Search ..... 463/16, 17, 18, 463/19, 20, 25, 30, 31, 40; 273/143 R, 138.2

(56) References Cited

U.S. PATENT DOCUMENTS 4,826,169 A * 5/1989 Bessho et al. ..... 273/143 R
6,089,977 A * 7/2000 Bennett ..... 463/20
6,190,254 B1 * 2/2001 Bennett ..... 463/13
6,251,013 B1 * 6/2001 Bennett ..... 463/13
6,290,600 B1 * 9/2001 Glasson ..... 463/20
6,311,976 B1 * 11/2001 Yoseloff et al. ..... 273/138.2

FOREIGN PATENT DOCUMENTS

WO WO 97/31344 * 8/1997 ..... G07F/17/34
WO 01/89646 A1 11/2001
WO 01/89647 A1 11/2001

* cited by examiner

*Primary Examiner*—Jessica Harrison
(74) *Attorney, Agent, or Firm*—Knobbe, Martens Olson & Bear, LLP

(57) ABSTRACT

A gaming machine having a display and a game controller arranged to control images displayed on the display. The game controller is arranged to play a game wherein at least one random event is caused to be displayed on the display. If a predefined winning event occurs, the machine awards a prize. The display displays a spinning reel game, each reel of which carries a plurality of symbols, at least one of which is a mystery symbol, the identity of which, at least initially, is hidden. When the mystery symbol appears on the display in a predetermined position, it is caused, by the controller and subject to predetermined conditions, to move to a different position whereafter the identity of the mystery symbol is revealed to be another symbol which is a symbol of a set of symbols of the game.

19 Claims, 9 Drawing Sheets

| POS | REEL 1 |
|---|---|
| 1 | JACK |
| 2 | TEN |
| 3 | KING |
| 4 | QUEEN |
| 5 | NINE |
| 6 | KING |
| 7 | SCATTER |
| 8 | NINE |
| 9 | JACK |
| 10 | TEN |
| 11 | WILD |
| 12 | QUEEN |
| 13 | NINE |
| 14 | KING |
| 15 | JACK |
| 16 | TEN |
| 17 | SYMBA |
| 18 | QUEEN |
| 19 | NINE |
| 20 | SYMBB |

50

GAMING MACHINE WITH MYSTERY NUDGE SYMBOL

RELATED APPLICATIONS

This application claims priority to the Australian application PR3011 filed Feb. 9, 2001 entitled "GAMING MACHINE WITH MYSTERY NUDGE SYMBOL".

FIELD OF THE INVENTION

This invention relates to a gaming machine. More particularly, the invention relates to a gaming machine and to an improvement to a game played on such a gaming machine.

BACKGROUND TO THE INVENTION

Players who regularly play gaming machines quickly tire of particular games and therefore it is necessary for manufacturers of these machines to develop innovative game features which add interest to the games. In so doing, it is hoped to keep players amused and therefore willing to continue playing the game as well as to attract new players.

Also, with the growth that has occurred in the gaming machine market, there is intense competition between manufacturers to supply various existing and new venues. When selecting a supplier of gaming machines, the operator of a venue will often pay close attention to the popularity of various games with their patrons. Therefore, gaming machine manufacturers are keen to devise games which are popular with the players as a mechanism for improving sales, retaining customers and attracting new customers.

SUMMARY OF THE INVENTION

According to the invention, there is provided a gaming machine having a display means and a game control means arranged to control images displayed on the display means, the game control means being arranged to play a game wherein at least one random event is caused to be displayed on the display means and, if a predefined winning event occurs, the machine awards a prize, the gaming machine being characterized in that the display means displays a spinning reel game, each reel of which carries a plurality of symbols, at least one of which is a mystery symbol, the identity of which, at least initially, is hidden and further being characterized in that, when said at least one mystery symbol appears on the display means in a predetermined position, it is caused, by the control means and subject to predetermined conditions, to move to a different position whereafter the identity of the mystery symbol is revealed to be another symbol which is a symbol of a set of symbols of the game.

The at least one mystery symbol may, initially, be covered by a mystery-signifying representation such as a question mark representation or a representation of a pair of binoculars. Once the at least one mystery symbol has been moved, or nudged, to said different position, the mystery-signifying representation may be removed to reveal the other symbol.

Instead, once the at least one mystery symbol has been moved, or nudged, to its final position, the at least one mystery symbol may be transformed into the other symbol. The transformation from the at least one mystery symbol to the other symbol may be effected by the at least one mystery symbol simply being replaced by the other symbol. Instead, the transformation may be by means of an animation sequence from the at least one mystery symbol to said other symbol.

Those skilled in the art will appreciate that, in a spinning reel-type game, there are paylines on which, if a prize-winning combination of symbols appears when the reels stop spinning and the payline is active, a prize is awarded. An "active" payline is one on which a player has made a wager. Each reel has a reel strip associated with it with each position on the reel strip being mapped to a predetermined position on its associated reel, at least one position on the reel strip being designated as a mystery symbol position.

The other symbol from the set of symbols of the game at the, or each, designated position may be predetermined. Instead, the at least one mystery symbol may, initially, be unidentified in the sense of not having any symbol from the set of symbols associated with it and only when the mystery symbol reaches its rest position is it converted by the control means into one of the other symbols.

The other symbol may be selected from one of (a) the entire set of symbols that is available on the reel strips and (b) a subset of the symbols. The subset of symbols is a set of special symbols such as, for example, a wild symbol, a scatter symbol, a top-paying symbol, a feature trigger symbol, or the like.

A prize may be paid for any prize-winning combination of symbols both before and after the at least one mystery symbol has been moved, or nudged, to its final position. Instead, the predetermined conditions may govern that the at least one mystery symbol moves, or is nudged, on to an active payline adjacent which the at least one mystery symbol is initially positioned only if it improves the prize applicable resulting from that combination of symbols which includes the other symbol revealed from the at least one mystery symbol. Still further, an initial prize may be paid and a further prize may be paid after the at least one mystery symbol has been moved and the other symbol revealed only if, as result of the move, the further prize is larger. Yet further, if an initial prize is payable before the at least one mystery symbol has been moved and the other symbol revealed and a further prize is payable after the at least one mystery symbol has been moved and the other symbol revealed, only the higher of the two prizes may be paid.

The predetermined conditions may further govern that, if the mystery symbol appears initially on an active payline of the game, no movement of the mystery symbol occurs.

BRIEF DESCRIPTION OF THE DRAWINGS

The invention is now described by way of example with reference to the accompanying diagrammatic drawings in which:-

DETAILED DESCRIPTION OF THE DRAWINGS

Figure 1:
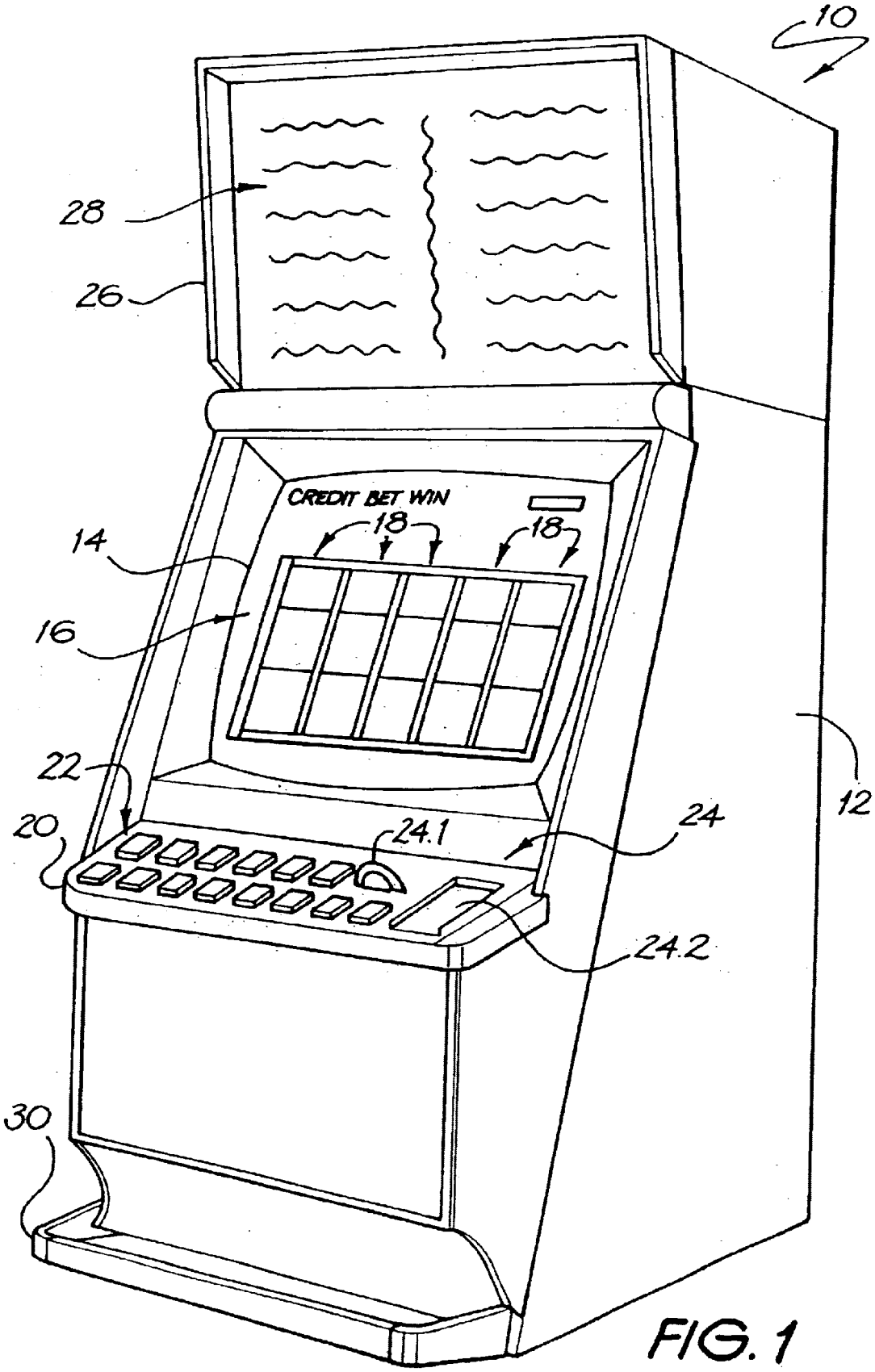
FIG. 1 shows a three dimensional view of a gaming machine, in accordance with the invention.

In FIG. 1, reference numeral 10 generally designates a gaming machine, including a game, in accordance with the invention. The machine 10 includes a console 12 having a video display unit 14 on which a game 16 is played, in use. The game 16 is a spinning reel game which simulates the rotation of a number of spinning reels 18. A midtrim 20 of the machine 10 houses a bank 22 of buttons for enabling a player to play the game 16. The midtrim 20 also houses a credit input mechanism 24 including a coin input chute 24.1 and a bill collector 24.2.

The machine 10 includes a top box 26 on which artwork 28 is carried. The artwork 28 includes paytables, details of bonus awards, etc.

A coin tray 30 is mounted beneath the console 12 for cash payouts from the machine 10.

Figure 2:
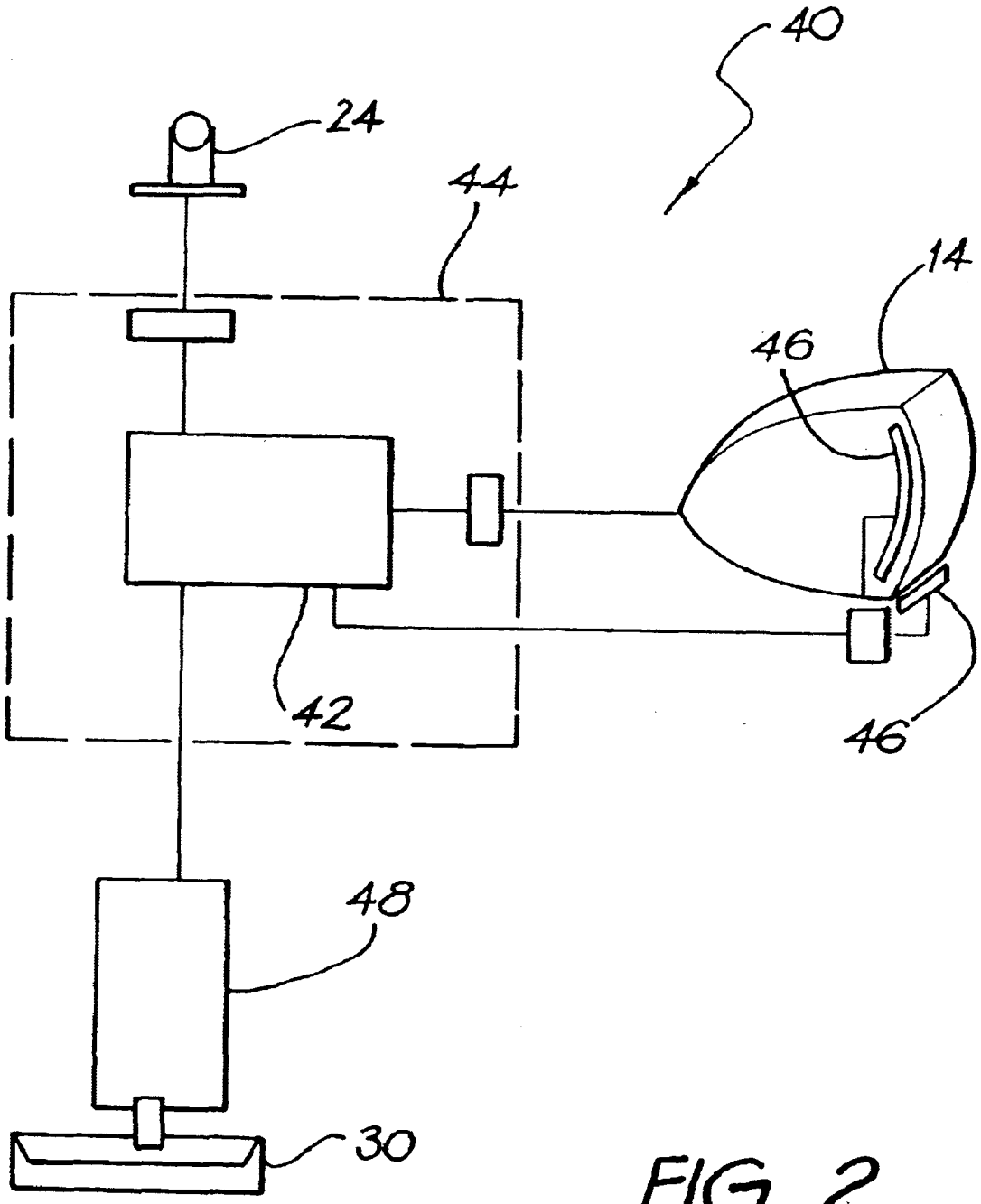
FIG. 2 shows a block diagram of a control circuit of the gaming machine.

Referring now to FIG. 2 of the drawings, a control means or control circuit 40 is illustrated. A program which implements the game and user interface is run on a processor 42 of the control circuit 40. The processor 42 forms part of a controller 44 which drives the screen of the video display unit 14 and which receives input signals from sensors 46. The sensors 46 include sensors associated with the bank 22 of buttons and touch sensors mounted in the screen. The controller 44 also receives input pulses from the mechanism 24 to determine whether or not a player has provided sufficient credit to commence playing. The mechanism 24 may, instead of the coin input chute 24.1 or the bill collector 24.2, or in addition thereto, be a credit card reader (not shown) or any other type of validation device.

Finally, the controller 44 drives a payout mechanism 48 which, for example, may be a coin hopper for feeding coins to the coin tray 30 to make a pay out to a player when the player wishes to redeem his or her credit.

Figures 3, 4A:
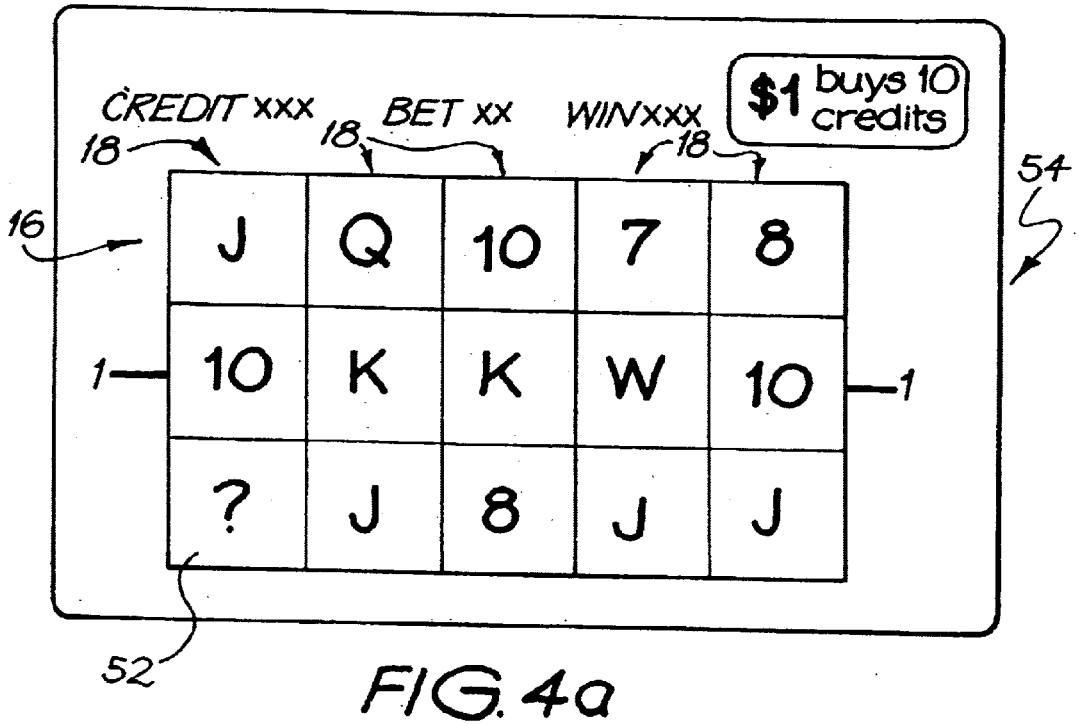
FIG. 3 shows a representation of a reel strip for a game played on the gaming machining of FIG. 1.
FIGS. 4*a* to 4*c* show screen displays of a first embodiment of the game.

In the game 16 played on the gaming machine 10, mystery symbols are carried on a reel strip 50, as shown in FIG. 3 of the drawings. When a mystery symbol spins up on a screen display, as will be described in greater detail below, the mystery symbol will, under certain circumstances, nudge to an optimal position before revealing what symbol it is.

Initially, as shown, for example, in FIG. 4*a* of the drawings, a mystery symbol 52 is designated, initially, by a question mark or by a symbol of a pair of binoculars on a screen display 54.

The reel strips 50 are laid out such that the carding around the mystery symbol 52 is the same for at least two different occurrences of the mystery symbol 52 with different predetermined outcomes on the same reel 18. The advantage of this is that even a person who has memorised every reel stop position would be unable to determine which of the standard symbols or which symbol of a predetermined subset of the standard symbols is covered by the question mark. Accordingly, as shown in FIG. 3 of the drawings, the mystery symbols are designated at positions 3, 11 and 17 on the reel strip 50. Hence, when any one of these positions is in a display position on the screen display 54 it will, initially, be represented by a mystery-signifying representation such as the question mark.

Figure 4B:
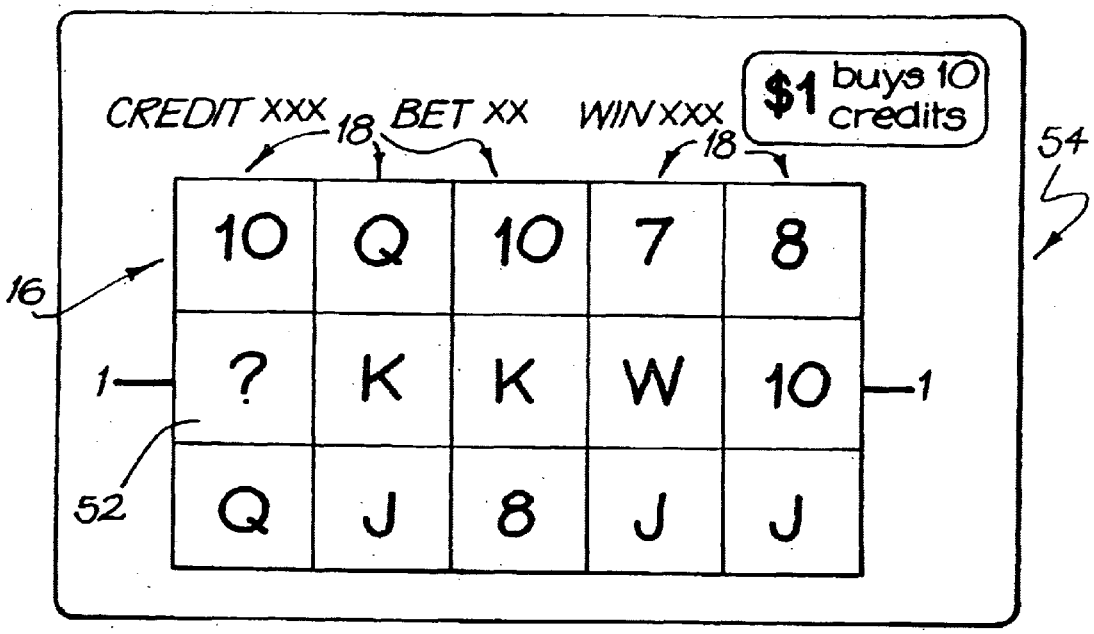

"In the embodiment of the invention shown in FIGS. 4*a* to 4*c* and 5 of the drawings, a mystery symbol 52 on the first reel 18 is initially spun up to the position shown in FIG. 4*a* of the drawings. The controller 44 causes the first reel 18 to nudge so that the mystery symbol now occupies a position on the active payline being payline 1 of the game 16 played on the gaming machine 10. This is shown in FIG. 4*b* of the drawings."

Figure 4C:
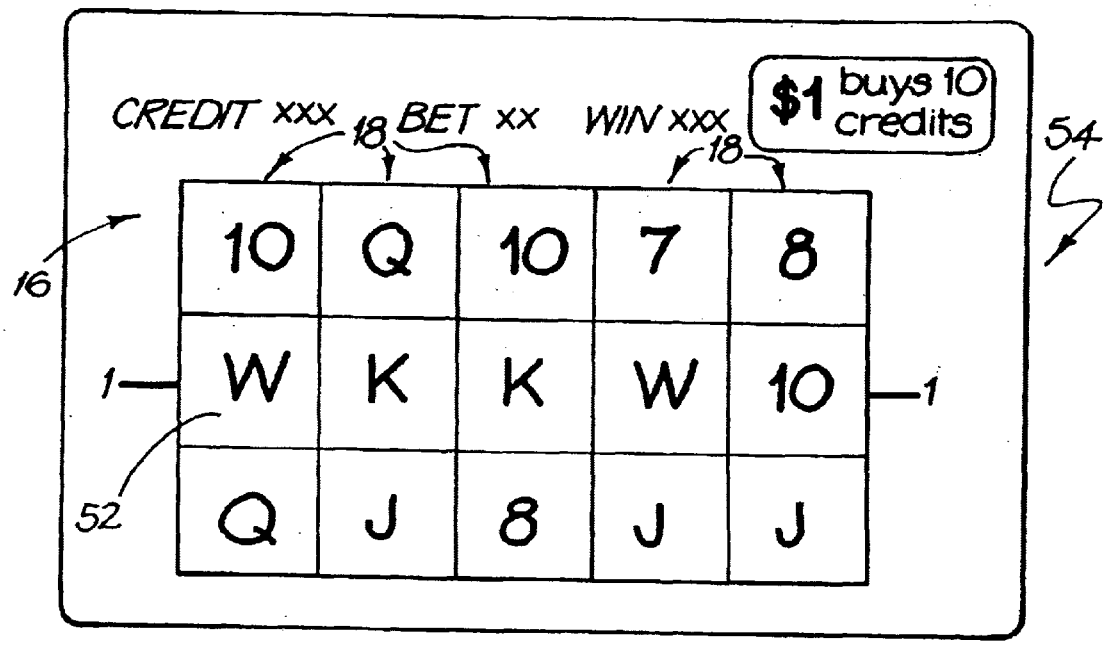
Figure 5:
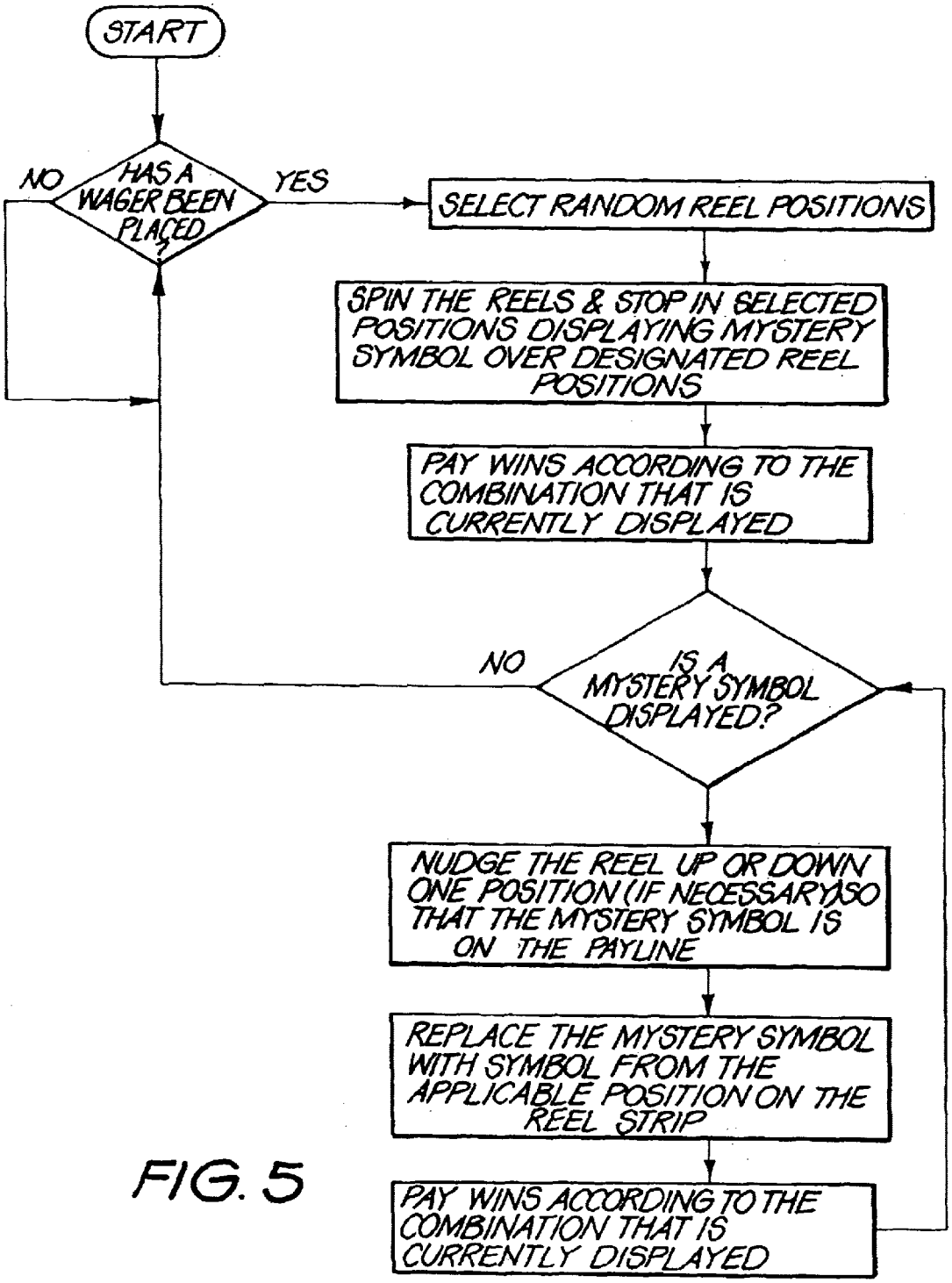
FIG. 5 shows a flow chart of the embodiment of the game of FIG. 4.

Once the mystery symbol 52 has been nudged into its final position, the mystery symbol 52 is "transformed" into the predetermined symbol at the relevant position on the reel strip 50 shown in FIG. 3 of the drawings. In the example illustrated, the "10" which was initially on payline 1 was at position 10 of the reel strip 50. Consequently, when the first reel 18 is nudged so that the mystery symbol 52 is brought on to payline 1, when the mystery symbol 52 transforms itself, it is transformed into the "wild" symbol which is at position 11 of the reel strip 50 as shown in FIG. 4*c* of the drawings. It will be appreciated that the reel strips 50 associated with each of the reels 18 could have at least one mystery symbol 52, not only the reel strip associated with the first reel 18.

Any applicable wins are then paid.

Figure 6:
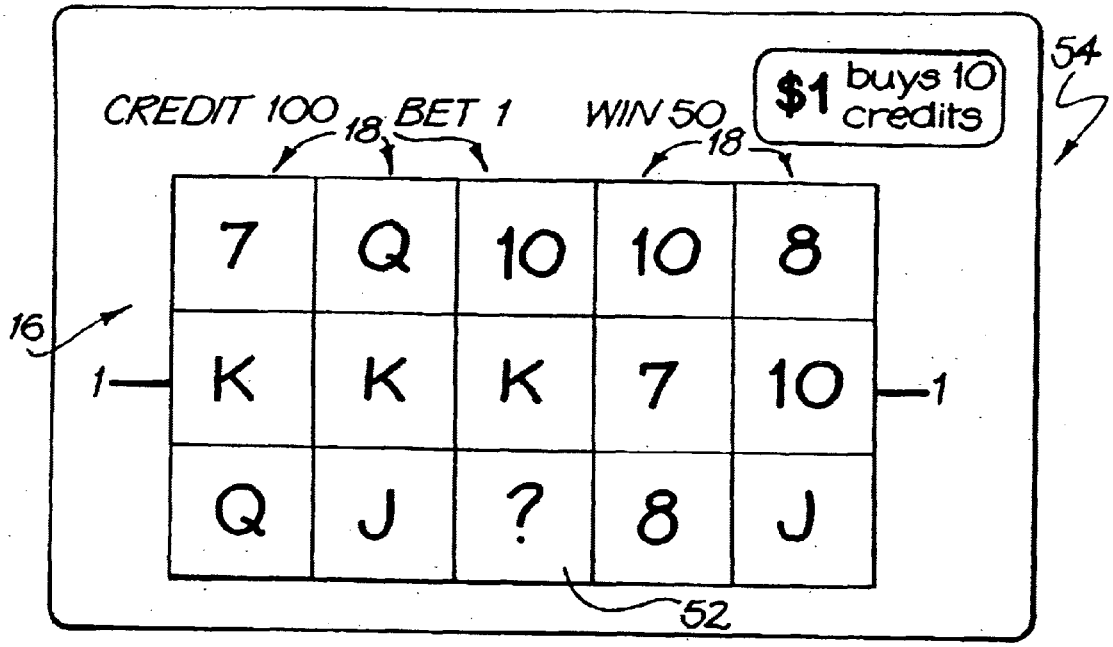
FIG. 6 shows a screen display of a second embodiment of the game.
Figure 7A:
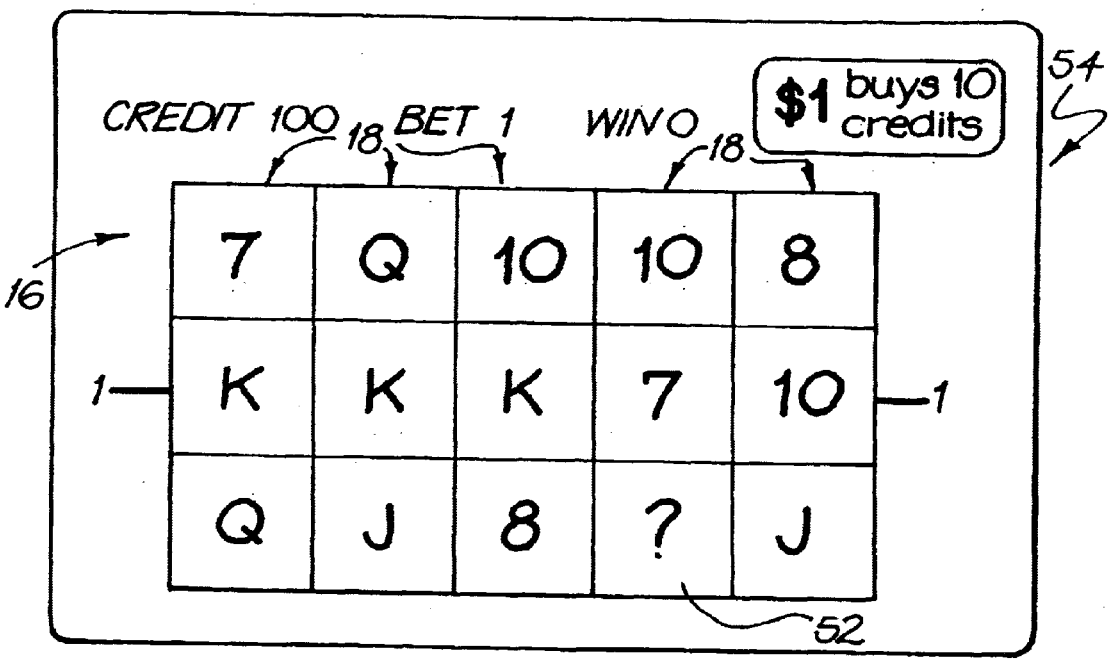
FIGS. 7*a* to 7*c* show screen displays of a further version of the second embodiment of the game.
Figure 7B:
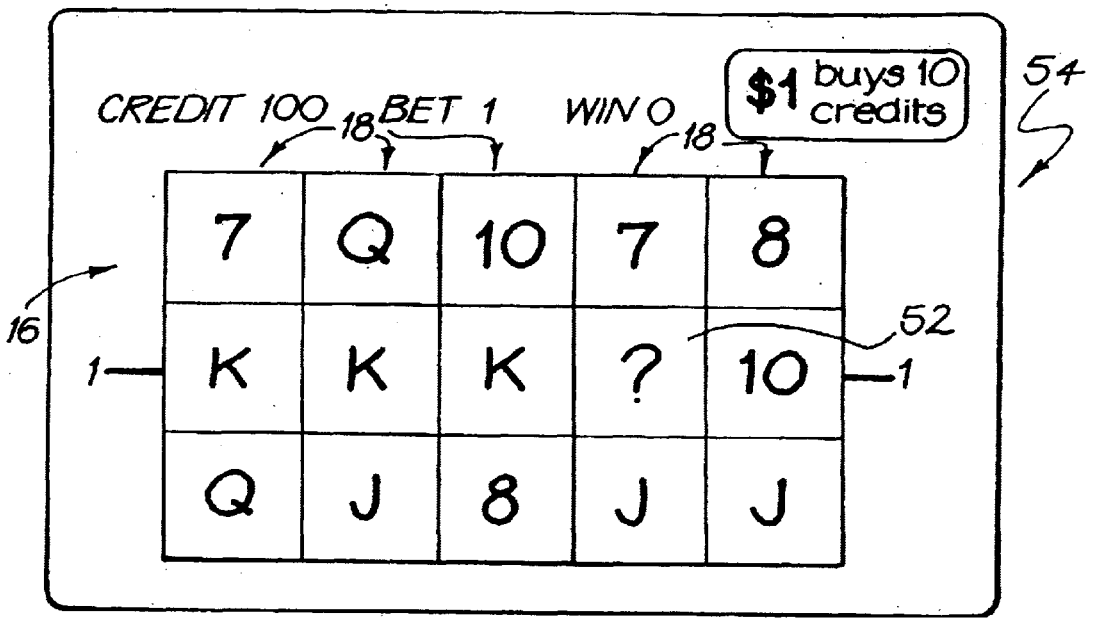
Figure 7C:
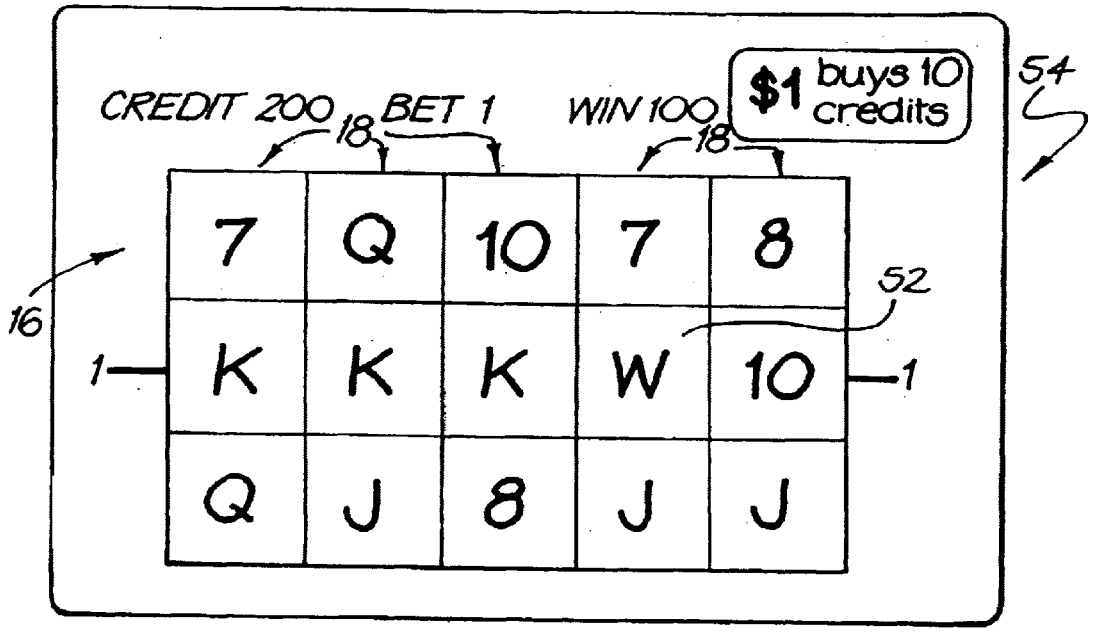
Figure 8:
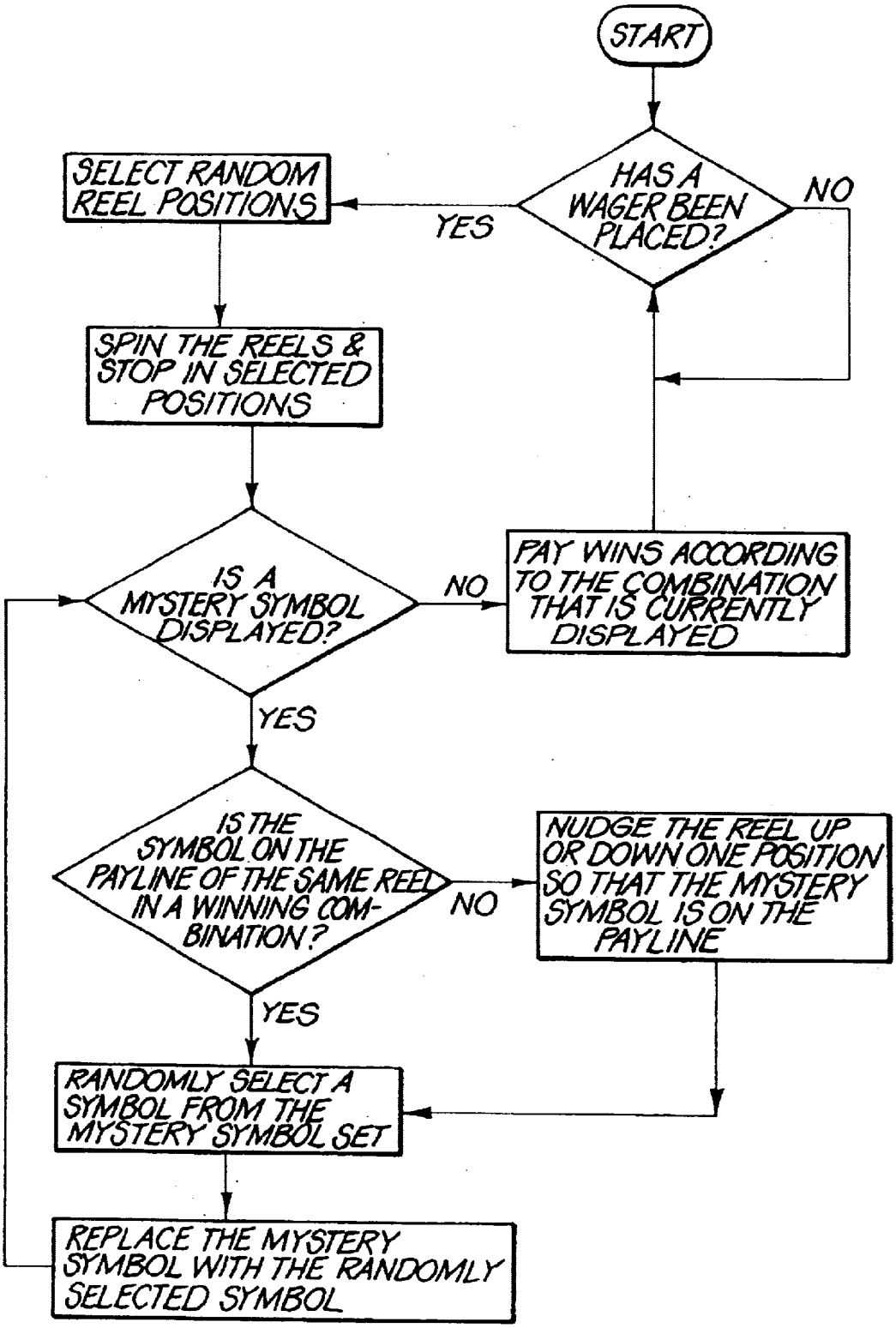
FIG. 8 shows a flow chart of the embodiment of FIGS. 6 and 7.

"A further embodiment of the game is shown in FIGS. 6, 7, and 8 of the drawings. With reference to FIGS. 3 and 4 of the drawings, like reference numerals refer to like parts, unless otherwise specified."

In this embodiment of the invention, instead of the mystery symbol 52 transforming itself, the mystery symbol 52 is embodied as a symbol in its own right on one or more of the reel strips.

When the mystery symbol 52, in this embodiment, spins up, it is transformed under the action of the controller 44 into one of a bonus symbol, a wild card symbol and a scatter symbol.

In the version of this embodiment of the invention shown in FIG. 6 of the drawings, the mystery symbol is spun up initially on payline 3. This is not an active payline in the example illustrated, only payline 1 being active. Due to the fact that a winning combination, being 3×K, already appears on payline 1 and that a K symbol is arranged on payline 1 above the mystery symbol 52 on the same reel 18, no nudge of the mystery symbol 52 occurs. This is because the mystery symbol 52 is below a symbol forming part of a winning combination on payline 1. Instead, the mystery symbol 52 remains where it is and the symbol is then selected by the controller 44 and revealed.

In the version of the second embodiment illustrated in FIGS. 7*a* to 7*c* of the drawings, the mystery symbol 52 in this case is initially spun up on payline 3. The symbol on the active payline, payline 1, of the same reel 18 as the mystery symbol, being the symbol 7, is not part of a winning combination. As a result, the fourth reel 18 is nudged under the action of the controller 44 so that the mystery symbol 52 is moved on to payline 1 as shown in FIG. 7*b* of the drawings. Then, under the action of the controller 44, the mystery symbol 52 is transformed into one of a bonus symbol, a wild symbol and a scatter symbol. In the embodiment illustrated, the mystery symbol 52 is transformed into a wild symbol as shown in FIG. 7*c* of the drawings. Once this occurs, any applicable prizes are paid.

In so far as these prizes are concerned, there are two options as to how prizes are awarded. It is to be noted that the 3×K combination initially on payline 1 is a winning combination. Thus, a first option is that a prize is paid for the 3×K before the mystery symbol 52 is nudged into position on payline 1. After the mystery symbol 52 has been nudged and transformed, if it results in an increased prize, for example, for 4×K as shown in FIG. 7*c* of the drawings, a further prize for 4×K is paid. Instead, the second option is that only the higher prize, being for 4×K, is paid once the mystery symbol 52 has been nudged into position on payline 1 and transformed to reveal the wild symbol.

Figure 9:
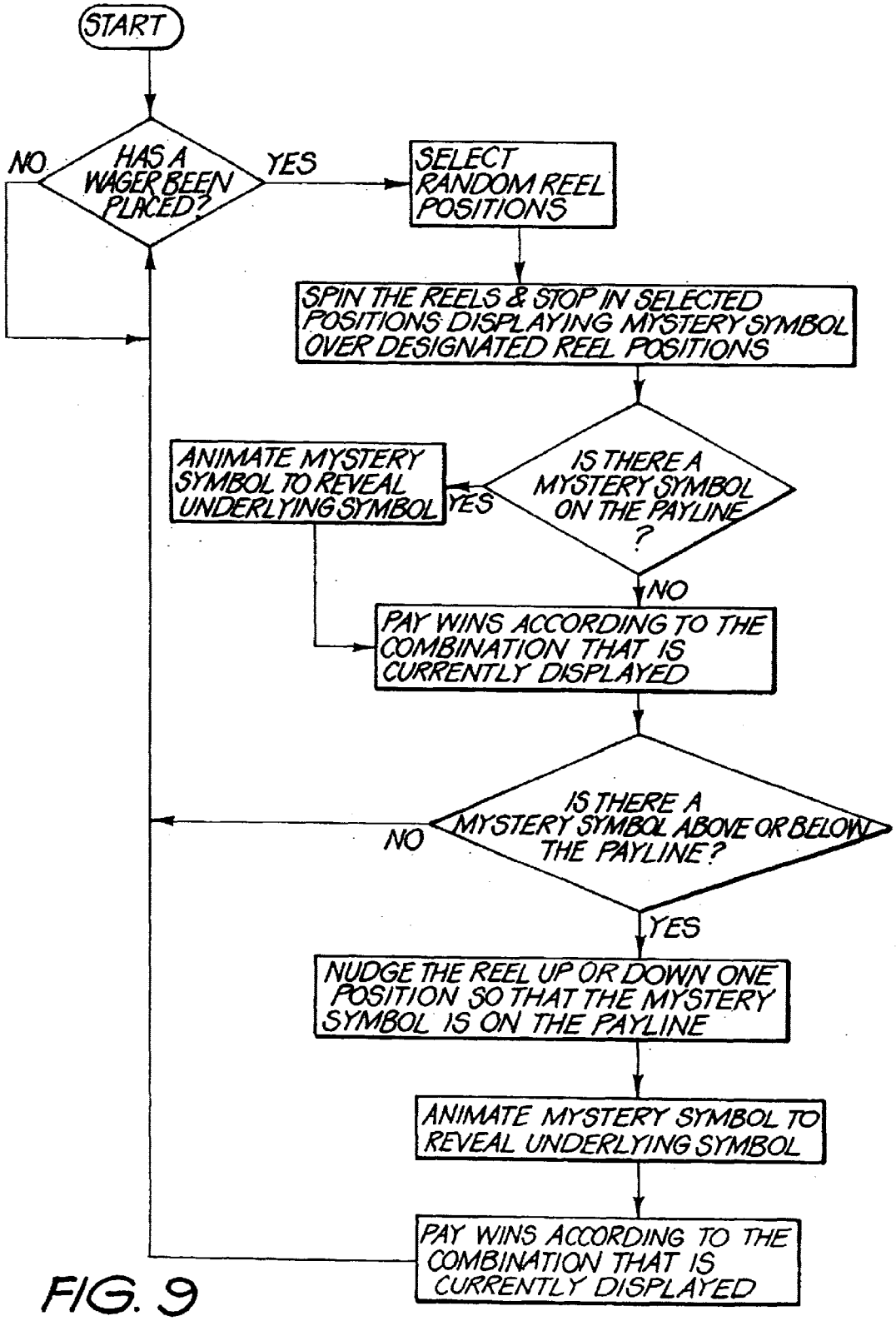
FIG. 9 shows a flow chart of yet a further embodiment of the game.

Referring to FIG. 9 of the drawings, a flow chart of yet a further embodiment is shown. In this embodiment it is assumed that only payline 1 is active. The game in question uses six reels with the sixth reel only carrying multipliers, not standard symbols. Further, the mystery symbol 52 only appears on one of the reels 18, for example, the second reel 18. The reel 18 carrying the mystery symbols carries more than one occurrence of the mystery symbol 52. However, the mystery symbols 52 are spaced on the reel strip 50 such that never more than one mystery symbol 52 is visible at any one time on the display 14.

Further, each mystery symbol 52 is predetermined in the sense that when it transforms, it always transforms into the same symbol from the set of symbols or the subset thereof described above. Each mystery symbol 52 on the reel strip 50 may, however, transform into a different symbol from the set of symbols or the subset thereof.

In this embodiment, if the mystery symbol 52 is initially spun up on payline 1, the mystery symbol 52 is transformed into its associated underlying symbol. If the underlying symbol forms part of, or results in, a prize winning combination, the relevant prize is awarded multiplied by whatever multiplier was on payline 1 on the sixth reel. If, however, the mystery symbol 52 is initially spun up above or below payline 1, any wins for prize winning combinations on payline 1 are paid multiplied by whatever the multiplier was on payline 1 on the sixth reel. Then the mystery symbol 52 is nudged up or down under the action of the controller 44, as the case may be, so that the mystery symbol is now on payline 1. Any win resulting from any new prize winning combination including the mystery symbol 52, multiplied, once again, by the multiplier, is then paid.

Accordingly, it is an advantage of the invention that a gaming machine 10 is provided having a game which will enhance player excitement and a sense of anticipation due to the presence of the mystery symbol.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. A gaming machine having a display and a game controller arranged to control images displayed on the display, the game controller being arranged to play a game wherein at least one random event is caused to be displayed on the display and, if a predetermined winning event occurs, the machine awards a prize, wherein the display displays a spinning reel game, each reel of which carries a plurality of symbols, at least one of which is a mystery symbol, the identity of which, at least initially, is hidden and wherein when the at least one mystery symbol appears on the display in a predetermined position, it is caused, by the controller and subject to predetermined conditions, to move to a different position whereafter the identity of the mystery symbol is revealed to be another symbol which is a symbol of a set of symbols of the game.

2. The gaming machine of claim 1 in which the at least one mystery symbol is, initially, covered by a mystery-signifying representation.

3. The gaming machine of claim 2 in which, once the at least one mystery symbol has been moved to said different position, the mystery-signifying representation is removed to reveal the other symbol.

4. The gaming machine of claim 1 in which, once the at least one mystery symbol has been moved to its final position, the at least one mystery symbol is transformed into the other symbol.

5. The gaming machine of claim 4 in which the transformation from the at least one mystery symbol to the other symbol is effected by the at least one mystery symbol simply being replaced by the other symbol.

6. The gaming machine of claim 4 in which the transformation is by means of an animation sequence from the at least one mystery symbol to said other symbol.

7. The gaming machine of claim 1 in which each reel has a reel strip associated with it with each position on the reel strip being mapped to a predetermined position on its associated reel, at least one position on the reel strip being designated as a mystery symbol position.

8. The gaming machine of claim 7 in which the other symbol at the at least one designated mystery symbol position is predetermined.

9. The gaming machine of claim 7 in which the at least one mystery symbol is, initially, unidentified and only when it reaches its rest position is it converted by the controller into the other symbol.

10. The gaming machine of claim 7 in which the other symbol is selected from one of the entire set of symbols available on the reel strips.

11. The gaming machine of claim 10 in which the subset of symbols is a set of special symbols.

12. The gaming machine of claim 10, wherein the other symbol is selected from a subset of the entire set of symbols available on the reel strips.

13. The gaming machine of claim 12, wherein the subset of symbols is a set of special symbols.

14. The gaming machine of claim 1 in which a prize is paid for any prize-winning combination of symbols both before and after the at least one mystery symbol has been moved to its final position.

15. The gaming machine of claim 1 in which the predetermined conditions govern that the at least one mystery symbol moves on to an active payline adjacent which the at least one mystery symbol is initially positioned only if it improves the prize applicable resulting from that combination of symbols which includes the other symbol revealed from the at least one mystery symbol.

16. The gaming machine of claim 1 in which an initial prize is paid and a further prize is paid after the at least one mystery symbol has been moved and the other symbol revealed only if, as result of the move, the further prize is larger.

17. The gaming machine of claim 1 in which, if an initial prize is payable before the at least one mystery symbol has been moved and the other symbol revealed and a further prize is payable after the at least one mystery symbol has been moved and the other symbol revealed, only the higher of the two prizes is paid.

18. The gaming machine of claim 1 in which the predetermined conditions govern that, if the mystery symbol appears initially on an active payline of the game, no movement of the mystery symbol occurs.

19. A game adapted for play on a gaming machine, the gaming machine having a display and a game controller arranged to control images displayed on the display, the game controller being arranged to play the game wherein the game comprises causing at least one random event to be displayed on the display and, if a predetermined winning event occurs, inducing the machine to award a prize and wherein the game comprises a spinning reel game, each reel of which carries a plurality of symbols, at least one of which is a mystery symbol, the identity of which, at least initially, is hidden and wherein when the at least one mystery symbol appears on the display in a predetermined position, it is caused, subject to predetermined conditions, to move to a different position whereafter the identity of the mystery symbol is revealed to be another symbol which is a symbol of a set of symbols of the game.

* * * * *